US005941055A

United States Patent [19]

Coates

[11] Patent Number: 5,941,055

[45] Date of Patent: Aug. 24, 1999

[54] APPARATUS FOR MAKING AN INSTANT BEVERAGE CONTAINER WITH PRODUCT THEREIN

[76] Inventor: Frank Coates, G122 Main Street Apartments, 1158 W. Main St., Lansdale, Pa. 19446

[21] Appl. No.: 08/993,905

[22] Filed: Dec. 18, 1997

Related U.S. Application Data

[60] Provisional application No. 60/033,945, Dec. 23, 1996.

[51] Int. Cl.[6] ..... B65B 47/04; B65B 47/00

[52] U.S. Cl. ..... 53/578; 53/575; 53/437; 53/523; 53/574; 53/329.3; 53/329.5; 425/112; 425/127; 425/134

[58] Field of Search ..... 53/575, 578, 437, 53/329.3, 329.5; 425/112, 125, 127, 394, 398

[56] References Cited

U.S. PATENT DOCUMENTS

| | | | |
|---|---|---|---|
| 616,452 | 12/1898 | Campbell | 53/575 |
| 1,958,762 | 5/1934 | Mirabella | 53/578 |
| 1,980,361 | 11/1934 | Spear | 53/578 |
| 2,026,403 | 12/1935 | Schlemmer | 53/578 |
| 2,365,920 | 12/1944 | Vaugn | 53/373.3 |
| 2,603,927 | 6/1952 | Grey | 53/578 |
| 2,690,634 | 10/1954 | Ketchpel et al. | 53/575 |
| 2,718,701 | 9/1955 | Fromwiller | 53/575 |
| 2,731,777 | 1/1956 | Wollersheim | 53/575 |
| 3,146,565 | 9/1964 | Otto | 53/575 |
| 3,186,139 | 6/1965 | Clauss | 53/578 |
| 3,227,273 | 1/1966 | Syverson et al. . | |
| 3,289,385 | 12/1966 | Syverson et al. . | |
| 3,407,924 | 10/1968 | Lewis et al. | 53/437 |
| 3,748,819 | 7/1973 | Christensson | 53/527 |
| 3,879,565 | 4/1975 | Einstman et al. . | |
| 4,024,694 | 5/1977 | Cooper et al. | 53/282 |
| 4,024,951 | 5/1977 | Green . | |
| 4,124,136 | 11/1978 | Bjelland et al. . | |
| 4,147,014 | 4/1979 | Tashiro et al. | 53/575 |
| 4,151,626 | 5/1979 | Bertaglia . | |
| 4,158,329 | 6/1979 | McKnight . | |
| 4,167,899 | 9/1979 | McCormick . | |
| 4,168,656 | 9/1979 | Wolfer . | |
| 4,169,540 | 10/1979 | Larsson et al. . | |
| 4,172,413 | 10/1979 | Roseberry . | |
| 4,174,006 | 11/1979 | Panneman . | |
| 4,241,564 | 12/1980 | Quarenghi | 53/575 |
| 4,445,311 | 5/1984 | Nentwig | 53/575 |
| 4,858,523 | 8/1989 | Helbling . | |
| 4,867,993 | 9/1989 | Nordskog . | |
| 4,872,403 | 10/1989 | LaGesse et al. . | |
| 5,135,764 | 8/1992 | Clausi et al. . | |
| 5,168,794 | 12/1992 | Glucksman . | |
| 5,496,573 | 3/1996 | Tsuji et al. . | |
| 5,518,743 | 5/1996 | Pergola et al. . | |

*Primary Examiner*—Stephen F. Gerrity
*Assistant Examiner*—Eric J. Weierstall
*Attorney, Agent, or Firm*—Ratner & Prestia

[57] ABSTRACT

An apparatus and method for making a beverage container which contains an instant beverage material individually sealed within the beverage container by a filter disk and an insert disk combination. The apparatus includes a mandrel having a flange and a forming die which is slideably mounted on the mandrel. The forming die has a chamfered outer surface which fits into a beverage container and an inner stepped portion which is configured to engage the flange of the mandrel and receive the filter disk and insert disk to be inserted into a beverage container. A funnel press is provided which has a funnel portion and a press portion. The press portion mates with the mandrel and forming die to draw a portion of the filter disk into the mandrel to simultaneously form a pocket in and crimp a filter disk which is subsequently loaded with an instant beverage material using the funnel portion. The mandrel and forming die interact, through sequential forming steps, to fold a portion of the filter disk over an insert disk and insert the filter disk, insert disk, and instant beverage material securely into the bottom of a beverage container.

17 Claims, 11 Drawing Sheets

APPARATUS FOR MAKING AN INSTANT BEVERAGE CONTAINER WITH PRODUCT THEREIN

CROSS REFERENCE TO RELATED APPLICATIONS

This application claims the benefit of U.S. Provisional Application No. 60/033,945, filed Dec. 23, 1996.

FIELD OF THE INVENTION

This invention relates generally to an apparatus and method for packaging instant beverages in a beverage container and the container produced by that apparatus and method.

BACKGROUND OF THE INVENTION

The prepackaging of an instant beverage material between stacked cups provides a quick and convenient way to dispense such products, which may be easily reconstituted by the addition of hot water for hot beverages or cold water for cold beverages. Hereinafter, the phrase "instant beverage material" shall be understood to mean any dehydrated, deliquescent, or hygroscopic material which can be reconstituted, rehydrated. or otherwise prepared by the addition of water or similar liquid.

U.S. Pat. No. 3,289,385 and No. 3,227,273 illustrate a conventional stack of cups and a method of packaging them, in which the beverage material is preferably deposited in a cap seat located at the underside of the bottom of each cup and is enclosed by a similar nested cup. The cap seat and the superimposed cup provided a generally sealed chamber when held together under axially applied force. A plastic overwrap and band secure the cups together and provide the axial force to hold the cups nested and provide a vapor barrier to lengthen the shelf-life of the product. The premeasured amount of material resides between adjacent cups and is dispensed by gravitational force when the lower cup of an upright stack is withdrawn from the stack. Upon the addition of hot water, the material dissolves or otherwise absorbs the moisture, resulting in a ready meal or hot drink, but without requiring the extensive facilities or appliances that are usually required to provide such a product.

In U.S. Pat. No. 3,289,385 and No. 3,227,273, the cups are filled with the material while the cup is inverted and the cap seat facing upwardly. The deposited material substantially fills the cap seat cavity. Cups having such cap seat cavities are standard paper or plastic coated paper cups which have been formed by machines which combine a frusto-conical, peripheral wall and a bottom circular disk in a conventional and well-known manner to complete the cup having the cap seat. Coffee, hot chocolate, and other materials have been packaged in the inverted cap seat. As disclosed in these patents, a sealed enclosure is formed when the next cup is telescoped to engage its bottom disk with the rim edge of the filled inverted cap seat. This cup-to-cup sealing engagement relies, however, on nesting of the cups to prevent sifting of the material in the sealed enclosure.

Attempts have been made to fill the cups from the top and to merely telescope the cups together without a seal enclosure for the materials in the cups. The results of such attempts have exhibited a number of deficiencies. One deficiency is that the enclosed material can sift out of the containment and between the walls of the stacked containers. Not only does this sifting action cause a loss of product and thus deprive the ultimate consumer of the proper portion, but the material which sifts past the walls of the stacked containers also makes the package of stacked cups unsightly if a transparent overwrap is used. Further, the sifted material will adhere to the outer cup wall and will be sticky and dirty when handled by the user.

In an attempt to remedy this problem, disclosed in U.S. Pat. No. 4,024,951 issued to Green is a package of stacked cups which contains dehydrated beverage product portions between adjacent cups. The cups are filled from the top and are configured to form a seal when nested to prevent sifting of the beverage product between adjacent cup walls. Preferably, the cups are retained in the stacked condition by applying a compressive, axially directed force to the cups using a plastic overwrap cover or by a restraining band which encircles the stack and tightly bears on the cups. The stacking cup arrangement disclosed by Green requires the use of cups, however, which must be specially formed to provide a seal when stacked. Thus, readily available cups with other stacking configurations cannot be used to achieve the stacking cups which are sealed. Second, the sealed stacking cups disclosed by Green rely on the adjacent cups which are nested to maintain the beverage product sealed within the cup. Upon removing a cup from the stack, the beverage product is no longer constrained within the cup and can be easily spilled. Third, in order to maintain the seal between the cups, the stacking arrangement must be held together with an overwrap or a restraining band.

The present invention overcomes the limitations, difficulties, and shortcomings of the prior art by providing an apparatus and method for making an instant beverage container and the product produced thereby which provides a premeasured amount of a beverage product securely constrained within the container.

SUMMARY OF THE INVENTION

The present invention provides an apparatus and method for making an instant beverage container which contains an instant beverage material individually sealed within the beverage container by a filter disk and an insert disk combination. The apparatus of the present invention includes a filter disk having a first portion; an insert disk; a mandrel having a flange; a forming die slideably mounted on the mandrel and having (a) a chamfered outer surface adapted to fit into the beverage container, and (b) an inner stepped portion configured to engage the flange of the mandrel and to receive the filter disk and insert disk; and a funnel press having a funnel portion and a press portion, the press portion mating with the mandrel and forming die to draw the first portion of the filter disk into the mandrel to simultaneously form a pocket in and crimp the filter disk which is subsequently loaded with the instant beverage material using the funnel portion. The mandrel and the forming die interact, through sequential forming steps, to fold a portion of the filter disk over the insert disk and insert the filter disk, insert disk, and instant beverage material securely into the bottom of the beverage container.

The apparatus produces, following the steps of the method of the present invention, a container for holding a beverage. The container has a bottom wall with a bottom surface. A side wall of the container extends from the bottom wall and has an inner surface. The bottom surface of the bottom wall and the inner surface of the side wall define a volume adapted to hold the beverage. An insert disk of the container has a top face, a bottom face, and an edge with a diameter slightly larger than the inner surface of the side wall adjacent the bottom surface of the bottom wall. The insert disk is positioned in the volume and maintained in the volume by a friction fit between the insert disk and the inner surface of the side wall adjacent the bottom surface of the bottom wall. An instant beverage material, which constitutes a precursor to the beverage, is disposed on the top face of the insert disk. Finally, the container has a filter disk with three integral portions. A first portion of the filter disk is disposed under the bottom face of the insert disk and clamped between the bottom face of the insert disk and the bottom surface of the bottom wall. A second portion is disposed adjacent the edge of the insert disk and clamped between the edge of the insert disk and the inner surface of the side wall. The third portion of the filter disk covers the instant beverage material.

As a result of these improvements in the present invention, because the containers are individually sealed with a filter, the beverage product remains constrained within the container without the need for stacking as in the prior art. This feature eliminates the need for any further measures to ensure that the containers or cups remain stacked to maintain the seal.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
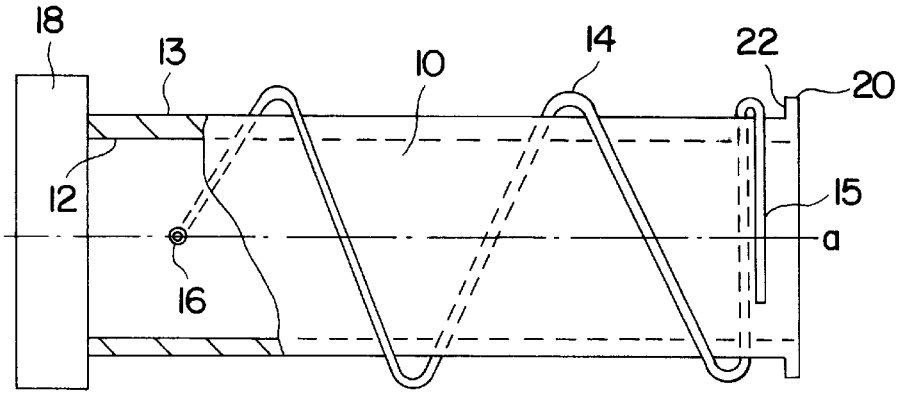
FIG. 1 is a partial cross-sectional view showing the relationship of a spring mounted on a mandrel of the apparatus according to the present invention.

Referring now to the drawing, wherein like reference numerals refer to like elements throughout, FIG. 1 shows a mandrel 10 mounted at one end onto a base 18 and having a compression spring 14 helically mounted around the longitudinal axis "a" of mandrel 10. One end of spring 14 is formed to provide a loop 15 and the opposite end of spring 14 is bent and engaged in a spring retaining hole 16 of mandrel 10. Mandrel 10 has an inner surface 12 and an outer surface 13 which are cylindrical and concentric. A flange 20 having an engaging surface 22 is located at the end of mandrel 10 opposite base 18.

Figure 2:
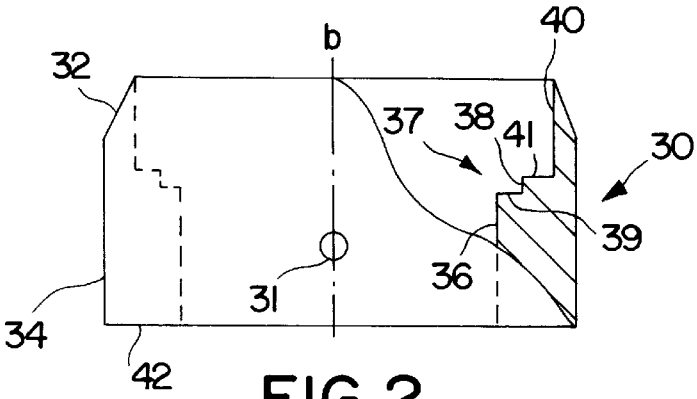
FIG. 2 is a partial cross-sectional view of a forming die of the apparatus according to the present invention.
Figure 3:
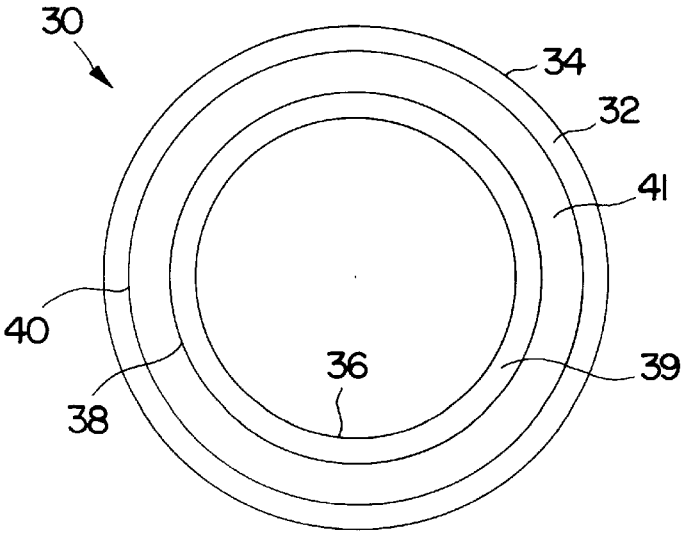
FIG. 3 is a top planar view of the forming die shown in FIG. 2.

Shown in FIGS. 2 and 3 is a forming die 30. Forming die 30 has an outer surface 34 and an inner surface 36 which are concentric cylinders formed around the longitudinal axis "b" of forming die 30. The diameter of inner surface 36 is slightly larger than the outer diameter of the outer surface 13 of mandrel 10. A chamfer 32 is provided and is angled to fit into a beverage container according to the method described in detail below. An inner stepped portion 37 is located in the end of forming die 30 having chamfer 32 and is comprised of concentric cylindrical portions 38 and 40 which are connected by insert support surface 41. A cylindrical portion 40 is configured to receive and has an inner diameter which is slightly larger than the outer diameter of an insert disk 60 described below. Stepped portion 37 is connected to inner surface 36 by a flange support surface 39. A spring support surface 42 is provided transverse to outer and inner surfaces 34 and 36, respectively, and has an outer diameter equal to or greater than the outer diameter of loop 15 of spring 14. A hook retaining hole 31 is located in outer surface 34 and extends at least partially through the thickness of forming die 30 toward inner surface 36.

Figure 4:
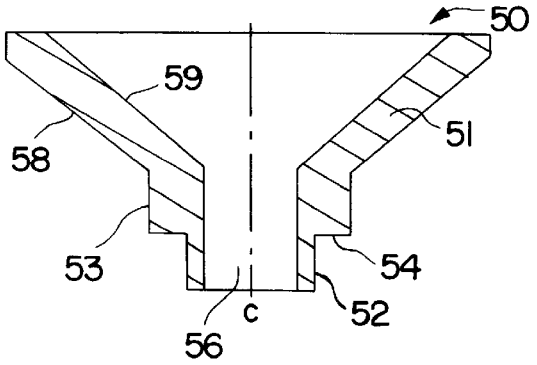
FIG. 4 is a cross-sectional view of a funnel press of the apparatus according to the present invention.
Figure 5:
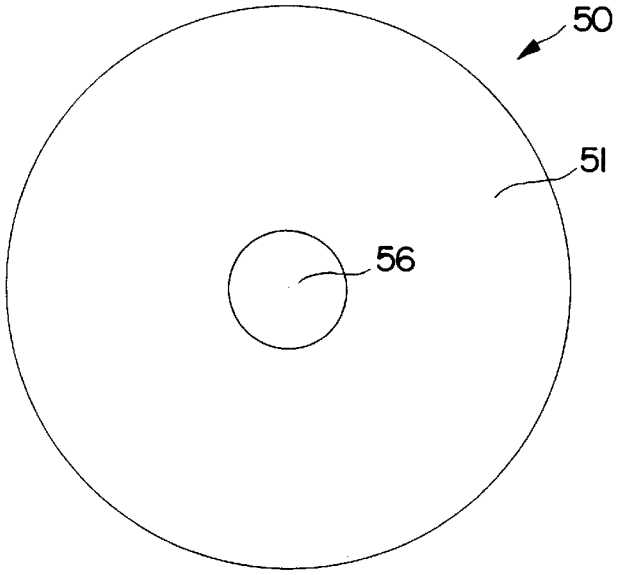
FIG. 5 is a top planar view of the funnel press shown in FIG. 4.

Shown in FIGS. 4 and 5 is a funnel press 50 having a funnel portion 51, a cylindrical press portion 52, and a through hole 56 all concentrically located along the longitudinal axis "c" of funnel press 50. Funnel press 50 has an outer surface 58 and an inner surface 59. A collar 53 and a shoulder 54 are defined between press portion 52 and funnel portion 51.

Figure 6:
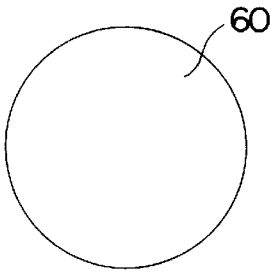
FIG. 6 is a planar view of an insert disk used in conjunction with the apparatus and method according to the present invention.

Shown in FIG. 6 is an insert disk 60 for insertion into the closed bottom portion of a beverage container according to the method described in detail below. Insert disk 60 is formed from a bio-compatible, rigid material and, preferably, is made of metal or plastic. Insert disk 60 is thin, preferably about 0.03125 inches thick, to avoid wasted space when inserted into the beverage container. Insert disk 60 has a diameter which is slightly greater than the inner bottom diameter of the beverage container into which insert disk 60 is to be inserted. As described below in greater detail, upon insertion of insert disk 60 according to the method of the present invention, the larger diameter of insert disk 60 provides a friction fit which wedges insert disk 60 inside the bottom of the beverage container. Insert disk 60 may even "bite" into the beverage container, penetrating the inside surface of the beverage container slightly, to create a seal.

Figure 7:
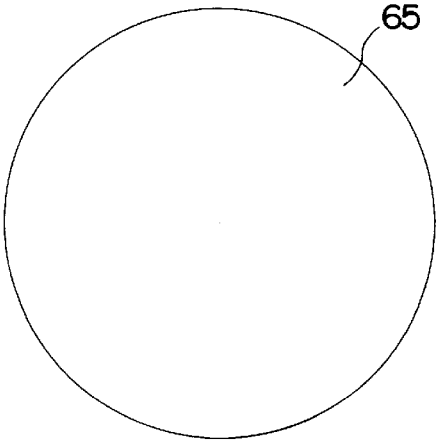
FIG. 7 is a planar view of a filter disk used in conjunction with the apparatus and method according to the present invention.

Shown in FIG. 7 is a filter disk 65 made of a filter material which is permeable by water. A conventional filter material, such as that used in conventional tea bags or coffee filters, may be used to manufacture filter disk 65. Filter disk 65 has an outer diameter greater then the outer diameter of forming die 30 to provide an overhang portion 66 which radially extends beyond chamfer 32 when placed on forming die 30 as shown and discussed below with respect to FIG. 12. Overhang portion 66 varies in diameter depending on the diameter of the beverage container and is provided to permit the folding and crimping operations according to the method discussed in greater detail below.

Figure 8:
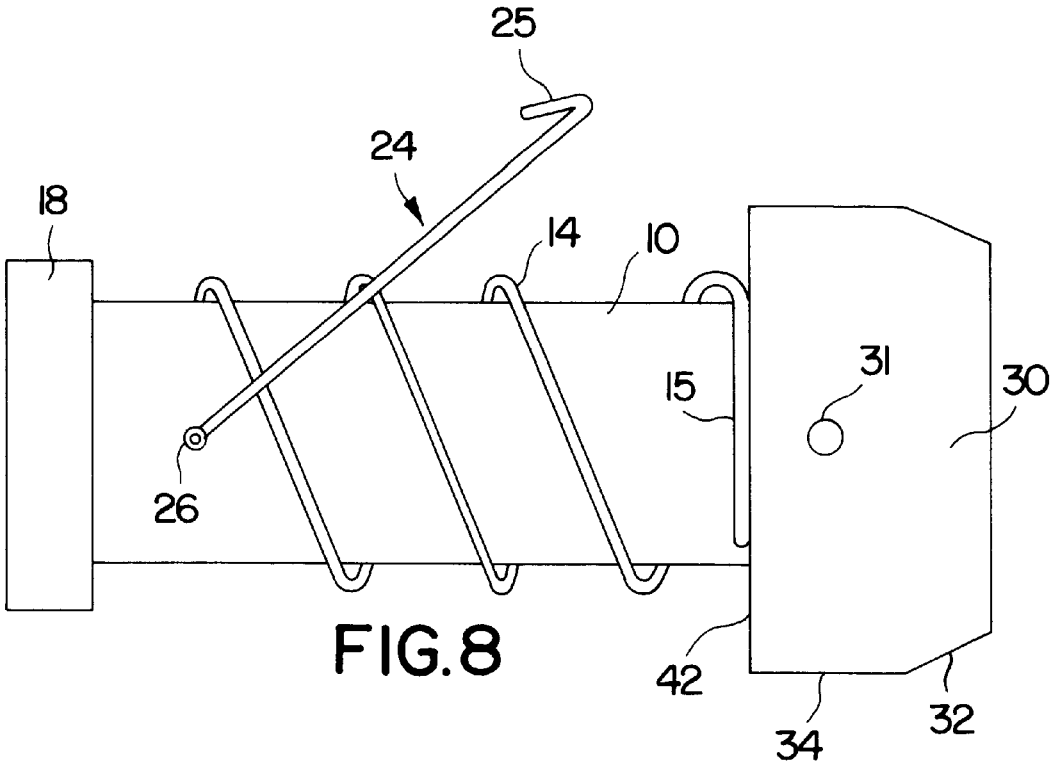
FIG. 8 is a planar view of an assembled apparatus according to the present invention shown in the non-compressed condition.
Figure 9:
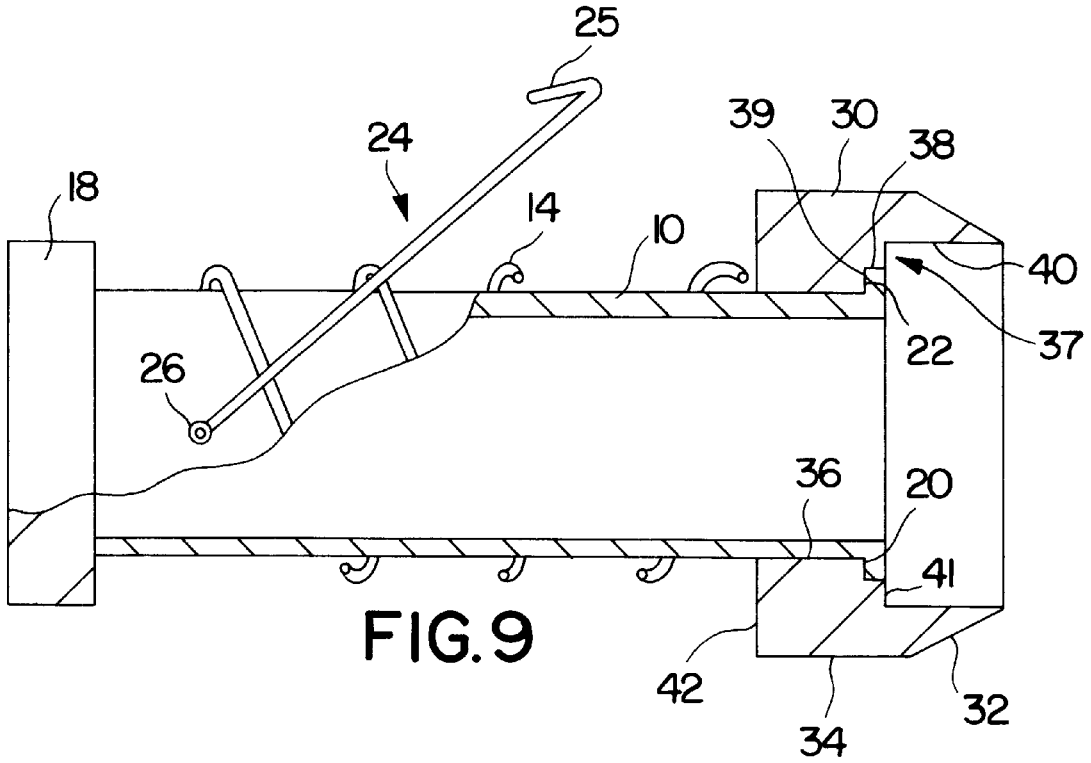
FIG. 9 is a partial cross-sectional view of the assembled apparatus shown in FIG. 8.

FIGS. 8 and 9 show an assembled apparatus according to the present invention constructed by inserting the end of mandrel 10 opposite flange 20 into the opening of forming die 30 defined by cylindrical portion 40 of stepped portion 37. Forming die 30 is then slideably mounted onto and along the longitudinal axis "a" of mandrel 10 toward flange 20. The end of mandrel 10 opposite flange 20 is then inserted into the loop 15 of spring 14. Spring 14 is then slid along the longitudinal axis "a" of mandrel 10 toward flange 20 until loop 15 rests against spring support surface 42. Spring 14 is then placed in compression. The end of spring 14 opposite loop 15 is bent and engaged in spring retaining hole 16 of mandrel 10 as shown in FIG. 1. By mounting spring 14 between spring retaining hole 16 and spring support surface 42 in this manner, the elastic force of spring 14 pushes loop 15 against spring support surface 42 and drives forming die 30 toward flange 20 so that engaging surface 22 of mandrel 10 meets flange support surface 39 of forming die 30. A lock mechanism 24 is shown with one end bent and inserted into a lock retaining hole 26 located in mandrel 10 and the opposite end having a hook 25 which is not latched. By this construction, forming die 30 is maintained in the biased state shown in FIGS. 8, 9, and 15–17, referred to herein as the "non-compressed condition."

Figure 10:
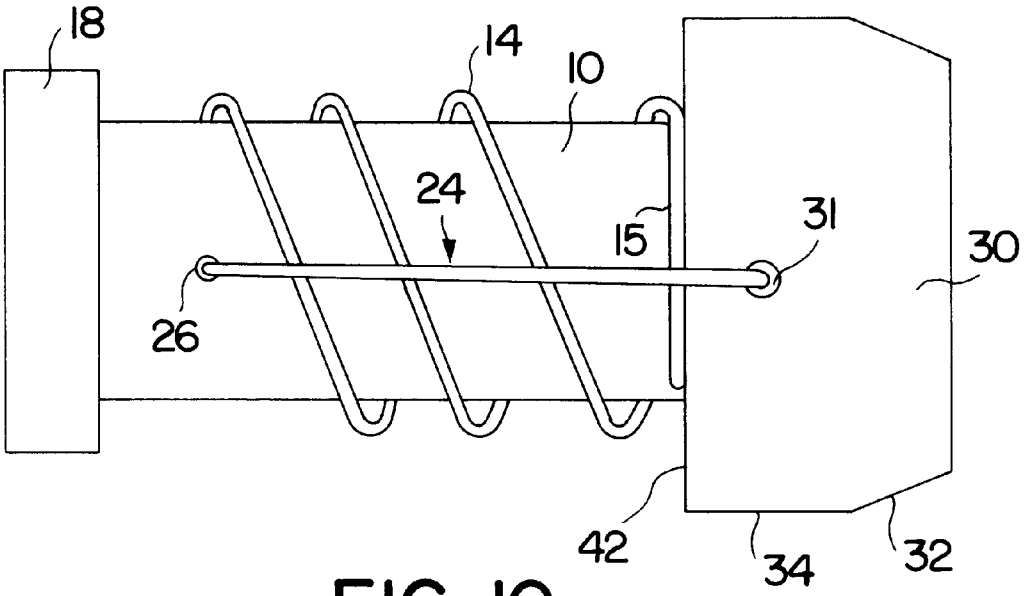
FIG. 10 is a planar view of an assembled apparatus according to the present invention shown in the compressed condition.
Figure 11:
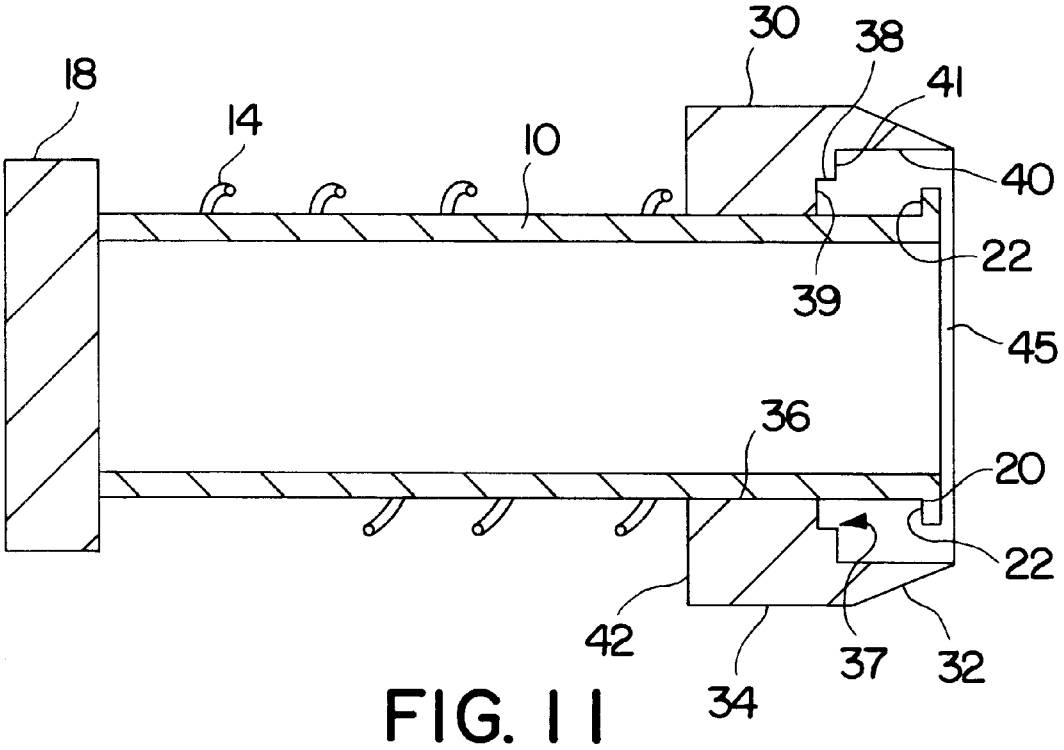
FIG. 11 is a cross-sectional view of the assembled apparatus shown in FIG. 10.

FIGS. 10 and 11 show an assembled apparatus substantially as shown and described with respect to FIGS. 8 and 9 after moving forming die 30 toward base 18 and inserting hook 25 of lock mechanism 24 into hook retaining hole 31 of forming die 30. Upon moving and locking forming die 30 in the position shown in the planar view of FIG. 10, flange 20 of mandrel 10 is separated from flange support surface 39 and biased within stepped portion 37 as shown in the cross-sectional views of FIGS. 11–14, referred to herein as the "compressed condition." The length of lock mechanism 24 is selected to locate flange 20 inside of forming die 30 so that recess 45 forms with sufficient depth in order to accommodate the thickness of insert disk 60 and filter disk 65 when placed in recess 45 as described below with respect to FIG. 14.

Figure 14:
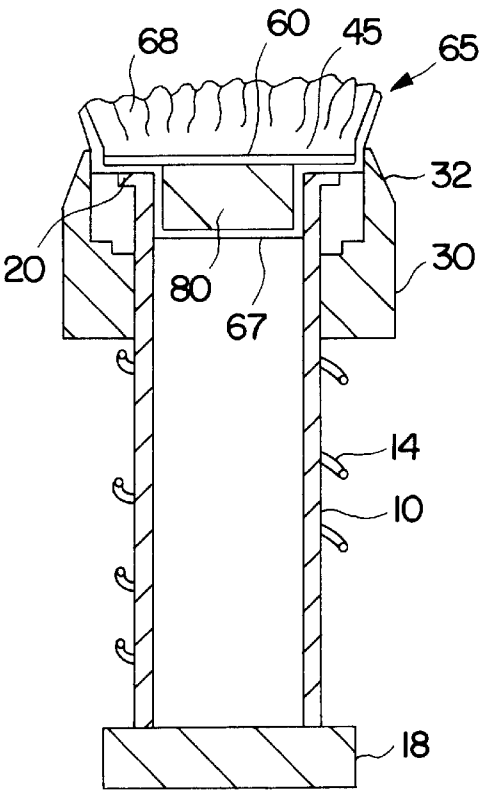
FIGS. 12–14 are cross-sectional views of the assembled apparatus in the compressed condition illustrating the steps of crimping and loading a filter disk with an instant beverage material and an insert disk according to the method of the present invention.
Figure 13:
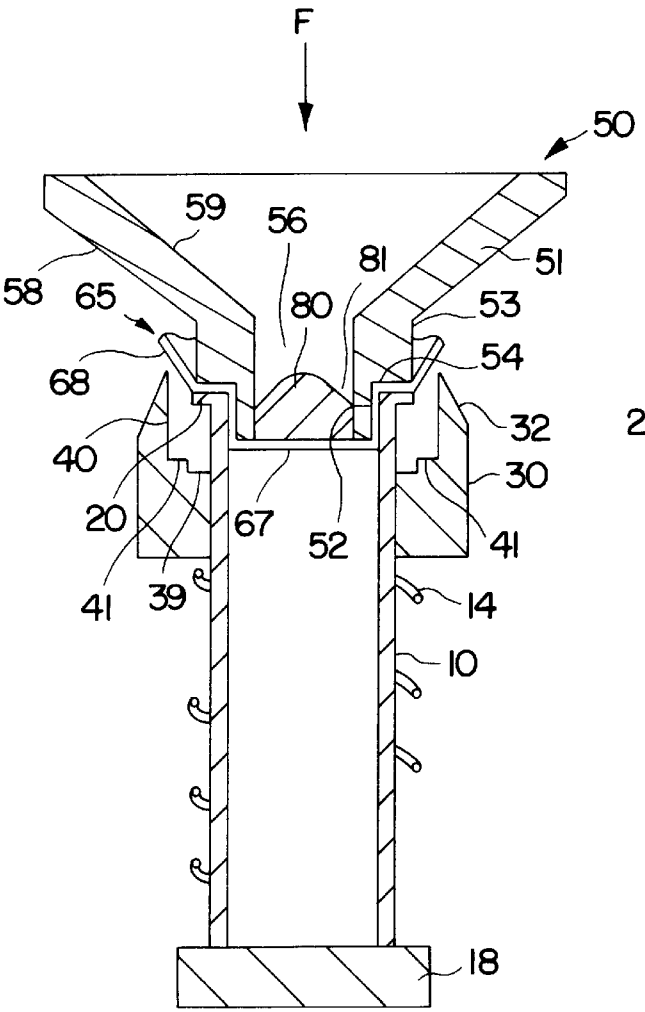
Figure 12:
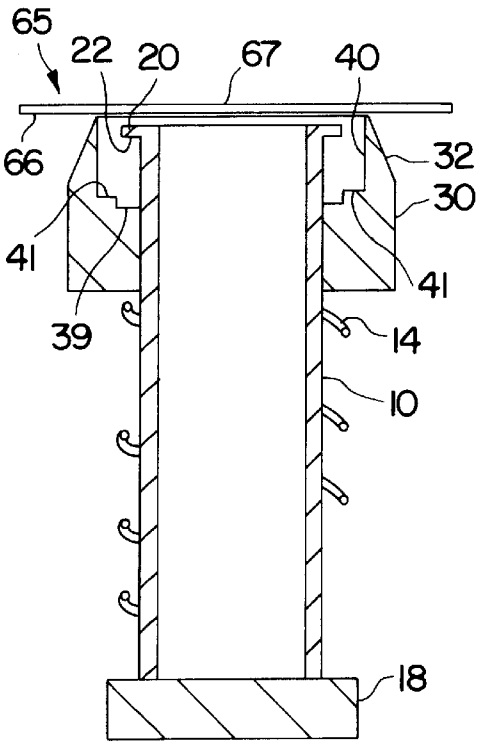

The operation of the apparatus and method of the present invention will be further described with reference to FIGS. 12–19. FIGS. 12–14 show the apparatus of the present invention in the compressed condition as shown and described above with respect to FIGS. 10 and 11. As shown in FIG. 12, filter disk 65 is placed over chamfer 32 of forming die 30. Filter disk 65 is centered over forming die 30 to provide a forming portion 67 and overhang portion 66 which are concentrically located around longitudinal axis "b" of forming die 30.

As shown in FIG. 13, cylindrical press portion 52 of funnel press 50 is inserted into the end of mandrel 10 having flange 20. A force is then applied to press funnel 50 in direction "F" toward base 18 thereby drawing forming portion 67 of filter disk 65 into mandrel 10 until flange 20 and shoulder 54 simultaneously crimp filter disk 65 and form a pocket 81 as shown. A measured amount of instant beverage material 80 is then loaded into pocket 81 via through hole 56 by pouring instant beverage material 80 into funnel portion 51 of funnel press 50. Once an amount of instant beverage material 80 sufficient to fill pocket 81 is provided, funnel press 50 is then removed and insert disk 60 is placed into recess 45 as shown in FIG. 14. As seen in FIG. 14, filter disk 65 has a pleated portion 68 which is produced during the formation of pocket 81 as described above.

Figure 15:
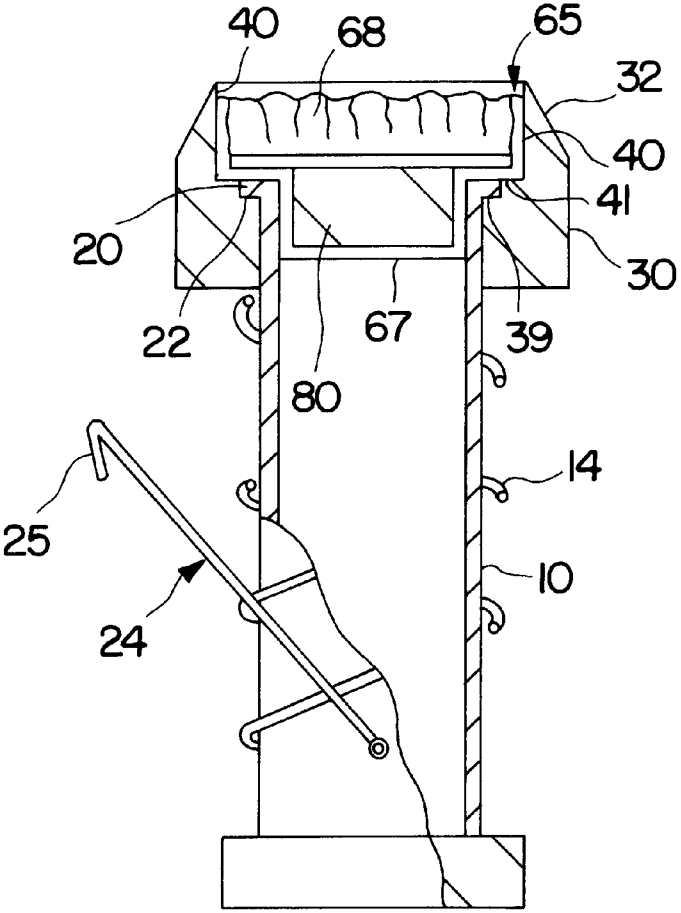
Figure 19:
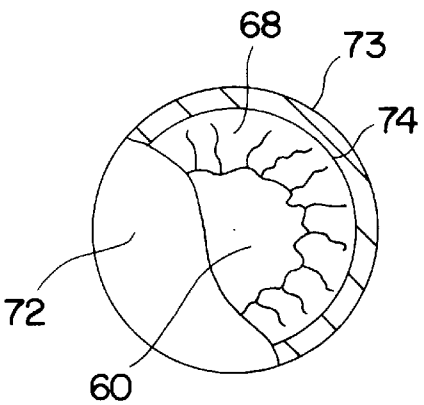
FIG. 19 shows a partial cross-sectional view of the bottom of the beverage container shown in FIG. 18.

The apparatus is then placed in the non-compressed condition by removing hook 25 of lock mechanism 24 from hook retaining hole 31. As shown in FIG. 15 and as discussed above, upon releasing lock mechanism 24, the elastic force provided by spring 14 pushes forming die 30 forward toward flange 20 so that engaging surface 22 of mandrel 10 meets flange support surface 39 of forming die 30. During the forward motion of forming die 30 toward flange 20, cylindrical portion 40 collects pleated portion 68 so that the pleated portion 68 is substantially perpendicular to and is contained within cylindrical portion 40 as shown in FIG. 15.

Figure 16:
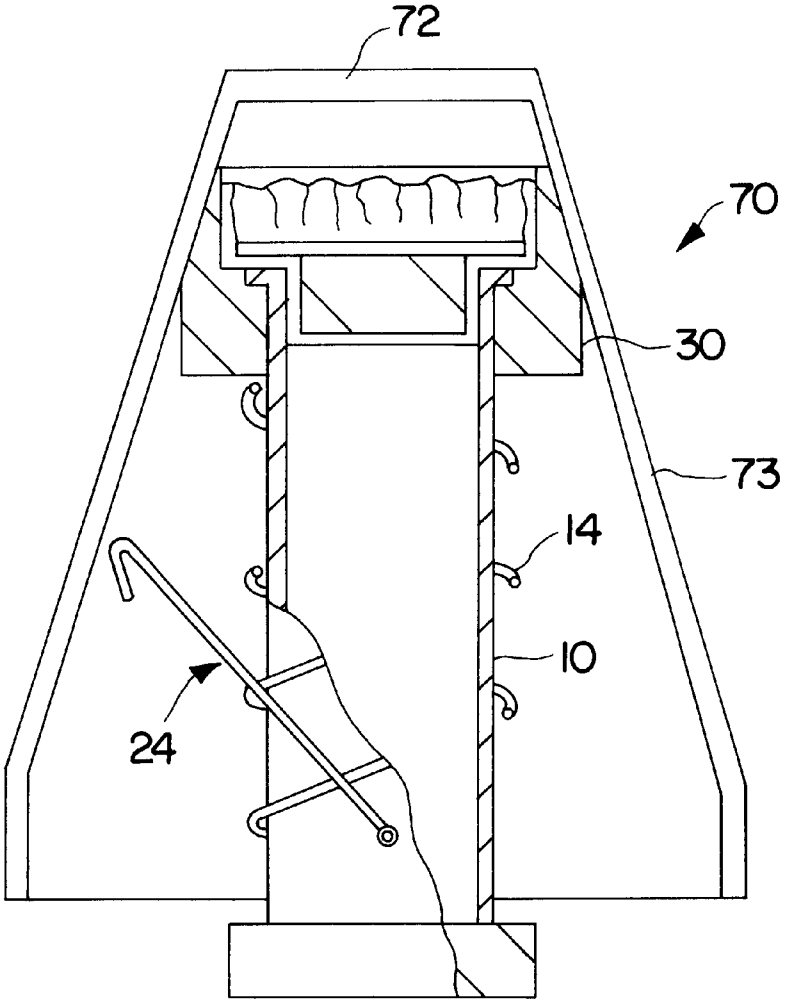
FIGS. 15–16 are partial cross-sectional views of the assembled apparatus in the non-compressed condition illustrating the steps of mounting a crimped filter disk loaded with an instant beverage material and an insert disk into a beverage container according to the method of the present invention.

A beverage container 70 is then inverted and placed over the apparatus in the non-compressed condition as shown in FIG. 16. Beverage container 70 is typically a cup of one-piece, integral construction and generally of truncated conical shape, including a tapered side wall 73, a horizontal bottom wall 72, and a lip 75. Beverage container 70 may be paper, plastic, or other conventional material.

Figure 17:
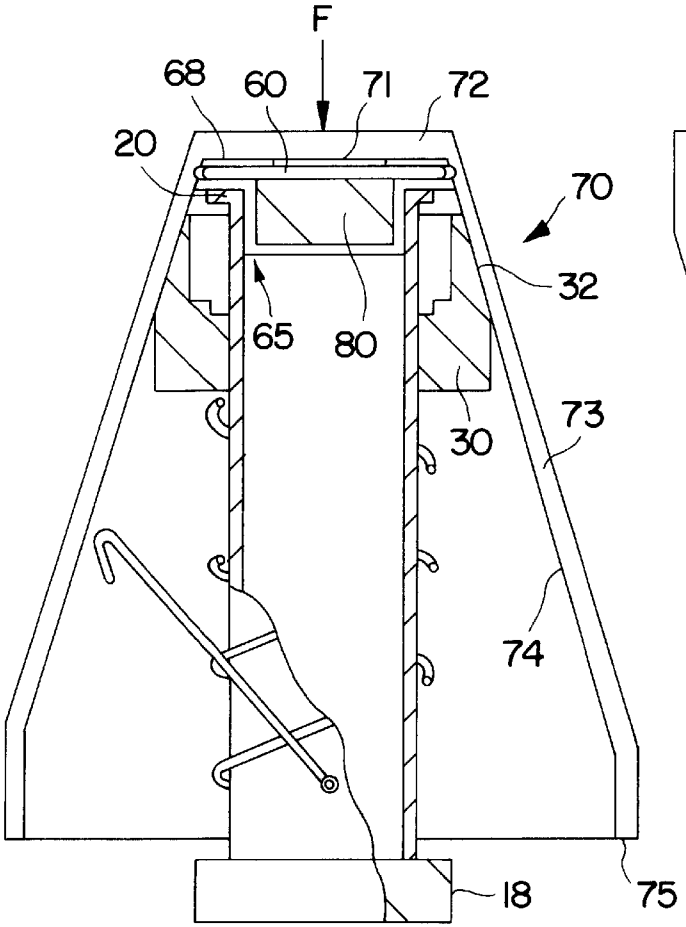
FIG. 17 is a partial cross-sectional view of the assembled apparatus illustrating the final step of loading the filter disk, instant beverage material, and insert disk into a beverage container according to the method of the present invention.

As shown in FIG. 17, an axial force is then applied to horizontal bottom wall 72 of inverted beverage container 70 in the direction "F" toward base 18 which causes the following sequence of steps to occur. First, chamfer 32 of forming die 30 engages and is stopped by the inner surface 74 of side wall 73 thereby preventing any further movement of forming die 30 with respect to beverage container 70. Upon further application of force in direction F, flange 20 continues to advance filter disk 65, insert disk 60, and instant beverage material 80 toward horizontal bottom wall 72 of beverage container 70. This continued forward motion causes pleated portion 68, upon contacting the bottom surface 71 of horizontal bottom wall 72, to fold back over insert disk 60 and wedge between insert disk 60 and bottom surface 71 as shown in FIGS. 17 and 18.

Figure 18:
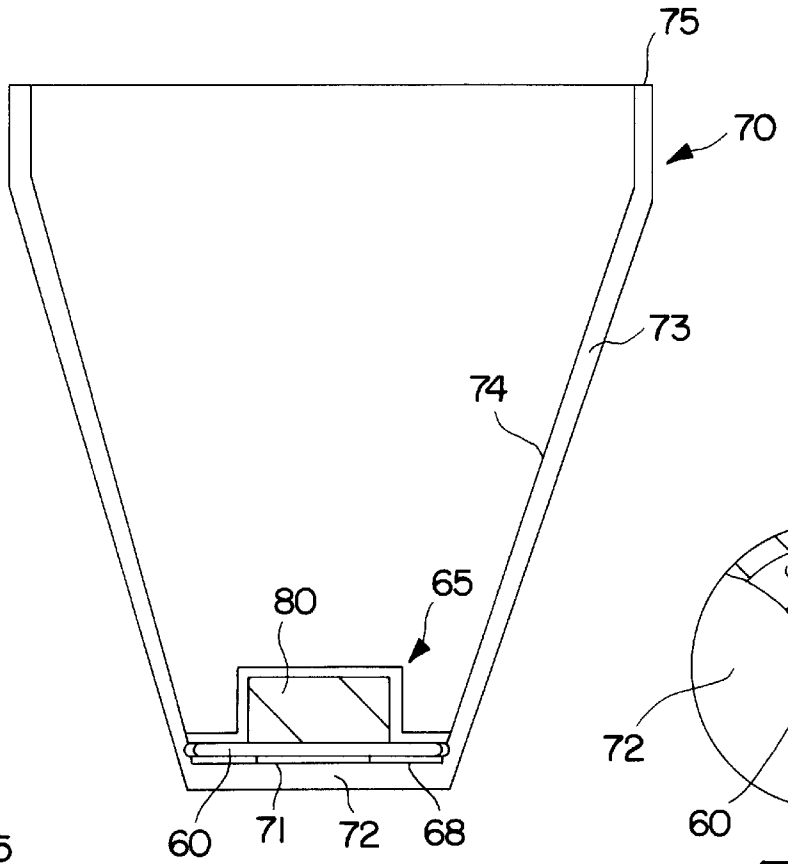
FIG. 18 is a cross-sectional view showing the finished instant beverage container produced according to the method of the present invention.

A finished beverage container 70, thus produced, is then removed from the apparatus and is shown in FIG. 18. Filter disk 65, insert disk 60, and instant beverage material 80 are maintained securely in beverage container 70 by the friction fit provided by insert disk 60 which has a slightly larger diameter than inner surface 74 of side wall 73 next to horizontal bottom wall 72. Insert disk 60 also exerts force upon pleated portion 68 which clamps pleated portion 68 against bottom surface 71 of horizontal bottom wall 72 and further secures filter disk 65, insert disk 60, and instant beverage material 80 inside beverage container 70.

As will be readily apparent to those having ordinary skill in the art, a variety of beverage containers may be incorporated into the method and used with the apparatus of the present invention and can include the uniform thin-wall plastic or paper cups and molded expanded polystyrene cups all of which are well-known, readily available, and often used for dispensing beverages. For containing a portion-size quantity of instant beverage material 80 in beverage containers 70 to be stacked, the beverage containers 70 are configured so that an enclosure space is defined between the alternating inner and outer surfaces of the horizontal bottom walls 72 upon nesting beverage containers 70. Preferred beverage containers which are stackable and may be used with the apparatus and method of the present invention are plastic drinking cups such as those available from Solo Cup Company, Urbana, Ill., or polystyrene drinking cups such as those available from Dart Container Corp., Mason, Mich. Of course, the enclosure space required for each cup depends on the nature of the material to be reconstituted and the quantity required, but a spacing of approximately 0.5 inches provided by an approximately 3.5 inch diameter polystyrene cup manufactured by Dart Container Corp., Mason, Mich., has been found to be sufficient to provide the necessary space for most kinds of instant beverage products.

It is understood that, although the description above refers to specific beverage container sizes and shapes, the present invention is not to be limited to these embodiments which are only exemplary. Rather, it will be ready apparent to those of ordinary skill in the art that a variety of available cups having any suitable configuration may be used with the method and apparatus by merely adjusting the dimensions of the various components of the apparatus which interact directly with the cup, the various workpieces used which are inserted into the cup, and the parts of the apparatus which interact with and manipulate the various workpieces. Examples of the various dimensions which must be adjusted with respect to the components of the apparatus which interact directly with the cup are the slope of chamfer 32 of forming die 30 and the length of mandrel 10 which must be increased or decreased depending upon the taper and height of the cup, respectively. Examples of the various dimensions which must be adjusted with respect to the workpieces used by the apparatus are the outer diameters of insert disk 60 and filter disk 65 which must be increased or decreased depending upon the inner surface diameter of the bottom of the cup to be used. Examples of the various dimensions which must be adjusted with respect to the parts of the apparatus which interact with the various workpieces are cylindrical portions 38 and 40 of forming die 30 which must be increased or decreased depending upon the size of the insert disk 60 and filter disk 65 used.

It is envisioned and to be understood that various conventional components may be incorporated either in place of or in combination with any of the configurations of the present invention disclosed to the extent that the parts are interchangeable. For example, the apparatus and method of the present invention may be automated by eliminating base 18 and mounting a plurality of mandrels 10 with a corresponding plurality of funnel presses 50 directly into an assembly line so that multiple beverage containers may be produced simultaneously. It will also be readily recognized that other conventional components may be used to move and maintain the mandrel in the various positions required throughout the loading method according to the present invention. As an example, a hydraulic actuator may be used in place of the spring and lock mechanism combination described above to accomplish this end.

Figure 21:
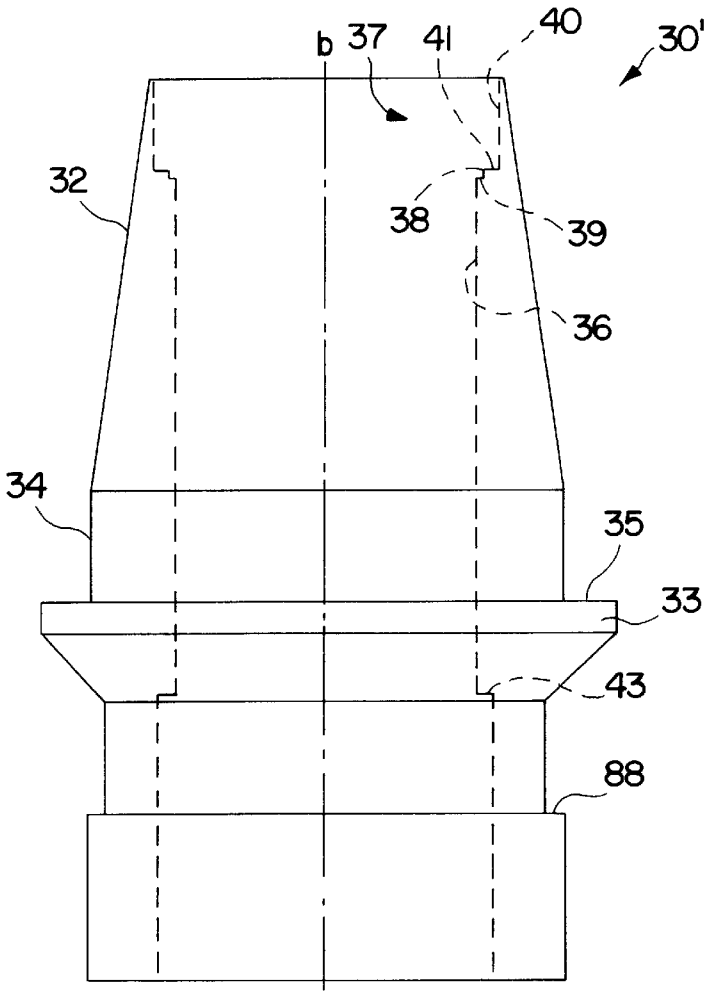
FIG. 21 is a partial cross-sectional view of an alternative embodiment of the forming die of the apparatus according to the present invention.
Figure 20:
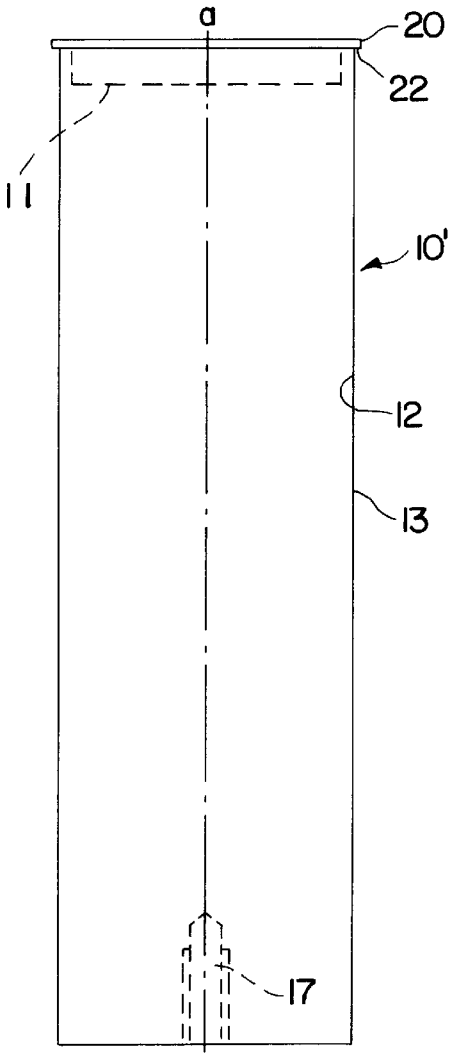
FIG. 20 is a partial cross-sectional view illustrating an alternative embodiment of the mandrel of the apparatus according to the present invention.

Specific, exemplary embodiments of mandrel 10 and forming die 30 suitable for automation are illustrated in FIGS. 20 and 21, respectively. The mandrel 10' has a flange 20 with an engaging surface 22 located at the end of mandrel 10' opposite the separate base 90 (see FIG. 23). A cavity 11 is provided in that end of mandrel 10' to receive cylindrical press portion 52 of funnel press 50. A bore 17 is provided in the opposite end of mandrel 10'. Bore 17 receives a conventional fastener, such as a bolt, to attach mandrel 10' to base 90. Mandrel 10' has a longitudinal axis "a." A standard compression spring 19 is helically mounted around the longitudinal axis "a" of mandrel 10' (see FIG. 23). Spring 19 may be attached to mandrel 10' or to base 90; alternatively, spring 19 may be unattached. Whether attached or not, spring 19 is disposed around mandrel 10' and constrained between base 90 and forming die 30' (and, particularly, shelf 43 of forming die 30').

A comparison between mandrel 10 of FIG. 1 and mandrel 10' of FIG. 20 indicates that mandrel 10' does not have an integral base 18. Moreover, mandrel 10' does not have a spring 14 with a loop 15, or a spring retaining hole 16, as does mandrel 10. On the other hand, mandrel 10 does not have the cavity 11 or the bore 17 of mandrel 10'.

Forming die 30' is shown in FIG. 21. Forming die 30' has an outer surface 34 and an inner surface 36 which are concentric cylinders formed around the longitudinal axis "b" of forming die 30'. The diameter of inner surface 36 is slightly larger than the outer diameter of the outer surface 13 of mandrel 10'. A chamfer 32 is provided and is angled to fit into beverage container 70. An inner stepped portion 37 is located in the end of forming die 30' having chamfer 32 and is comprised of concentric cylindrical portions 38 and 40 which are connected by insert support surface 41. A cylindrical portion 40 is configured to receive and has an inner diameter which is slightly larger than the outer diameter of insert disk 60. Stepped portion 37 is connected to inner surface 36 by a flange support surface 39. Shelf 43 of forming die 30' is provided to engage spring 19.

In contrast to forming die 30 of FIG. 2, forming die 30' does not have a spring support surface 42. There is also no need, in forming die 30', for a hook retaining hole 31 as is located in outer surface 34 of forming die 30. Instead, forming die 30' has a shelf 43. Forming die 30' also has a projection 33 defining a ledge 35 upon which the lip 75 of beverage container 70 may abut when beverage container 70 is disposed over forming die 30'. Forming die 30' still further has a catch 88 which engages a latch 95 as described below.

Figure 22A:
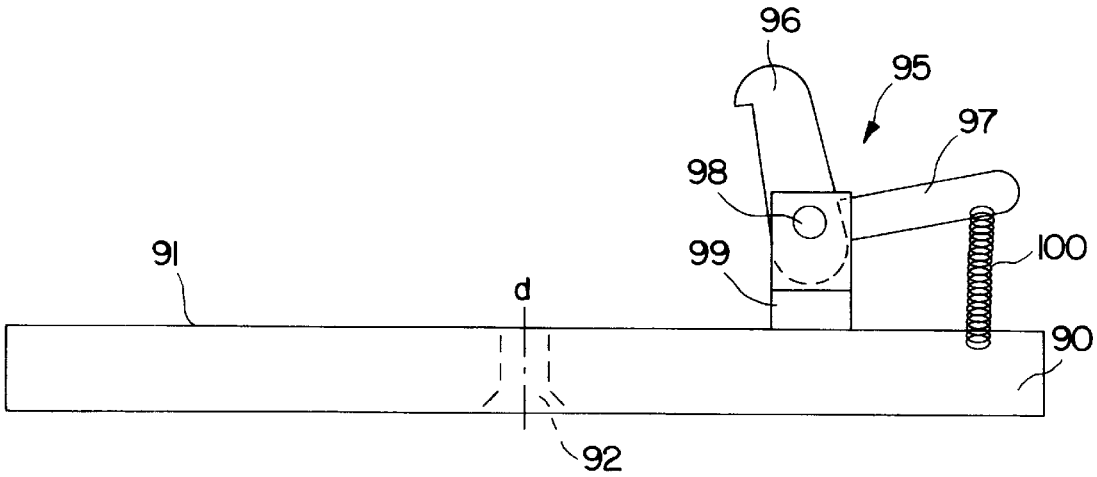
FIG. 22*a* is a partial cross-sectional side view of a separate base used in connection with the mandrel and forming die illustrated in FIGS. 20 and 21, respectively.
Figure 22B:
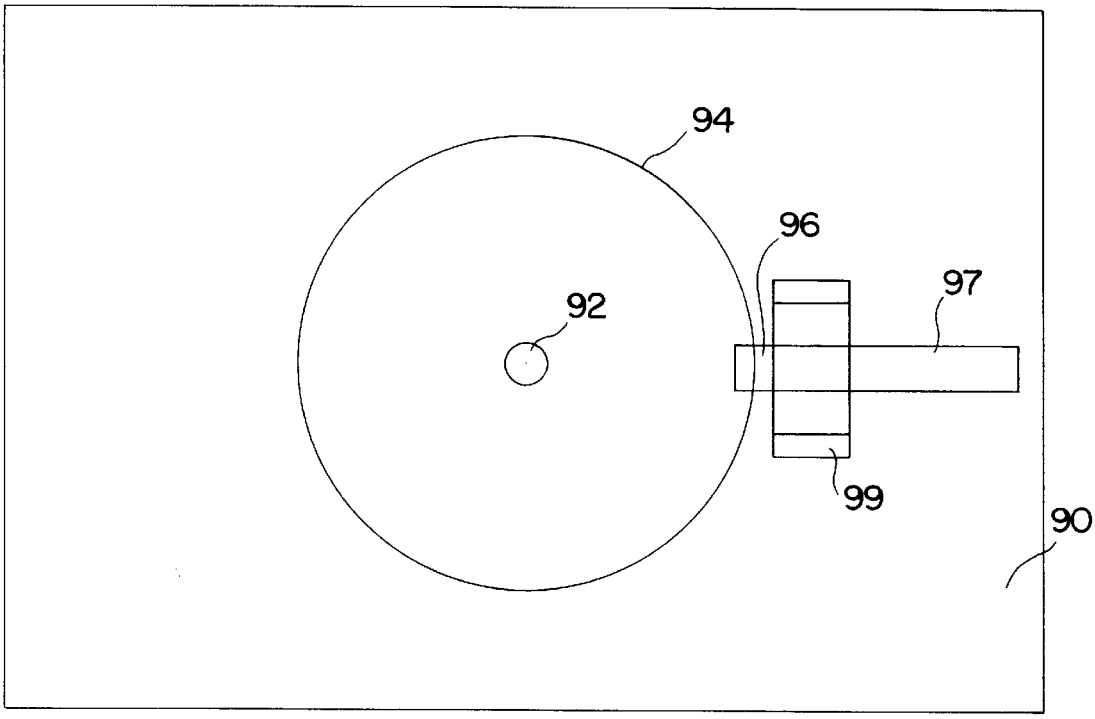
FIG. 22*b* is a top view of the base illustrated in FIG. 22*a;*

FIGS. 22*a* and 22*b* illustrate the separate base 90 used in connection with mandrel 10' and forming die 30'. Base 90 has an aperture 92 which corresponds to bore 17 in mandrel 10'. Aperture 92 is concentrically formed around longitudinal axis "d." When mandrel 10' is positioned on the top surface 91 of base 90 (see FIG. 23), within circumference 94, bore 17 engages aperture 92. Attached to top surface 91 of base 90 is a latch 95 through latch support 99. Base 90 may be a large, circular platen having a series of mandrels 10' positioned on top surface 91 around the perimeter of the platen. In this configuration, individual mandrels 10' can be rotated through a series of stations as described more fully below with respect to FIG. 24.

Figure 23:
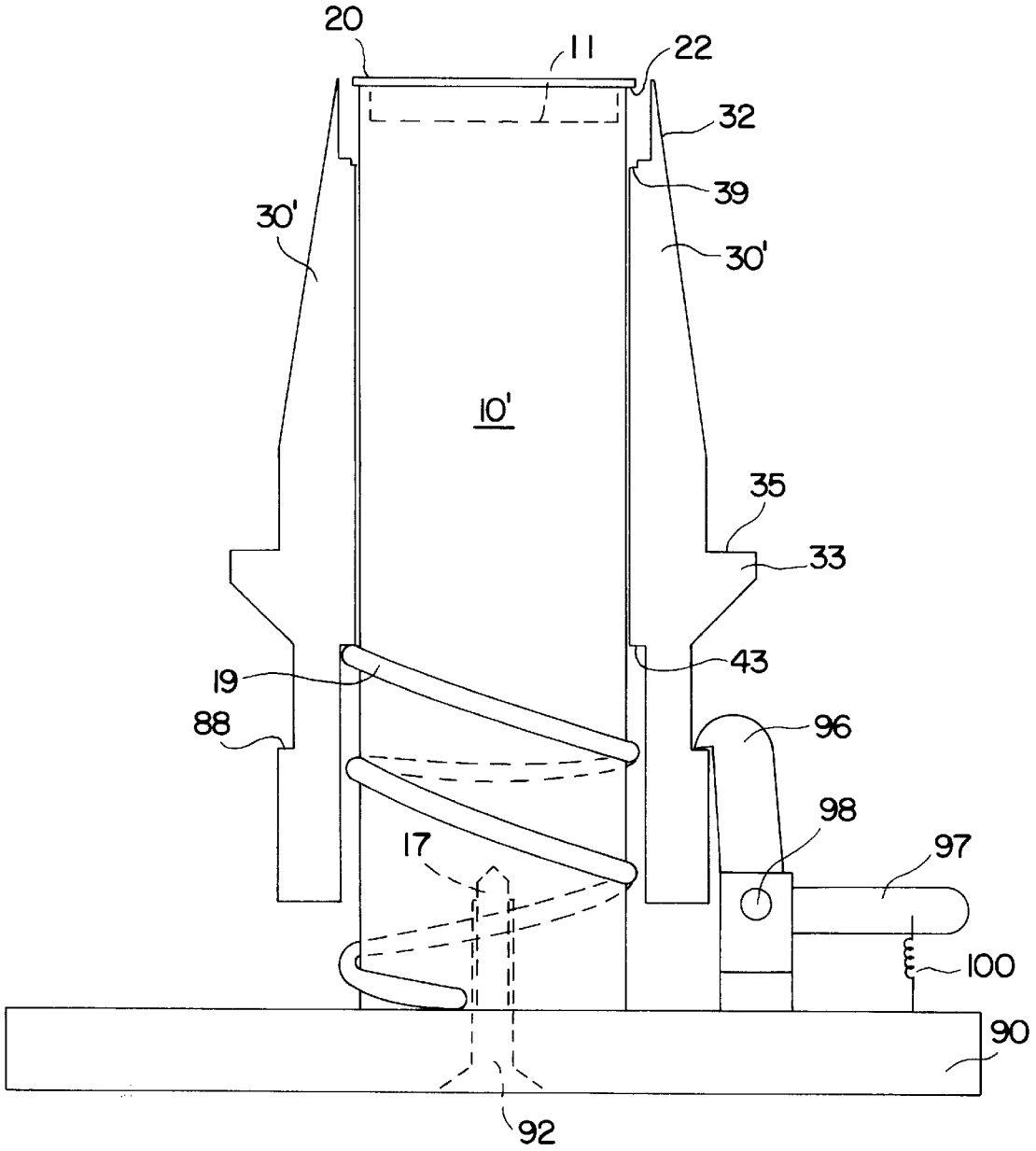
FIG. 23 is a partial cross-sectional side view of the mandrel, forming die, and base (illustrated in FIGS. 20, 21, and 22*a* and 22*b,* respectively) as assembled.

Latch 95 has a hook 96, which engages catch 88 of forming die 30', and a handle 97 integral with hook 96. A pivot point 98 is provided at the junction between hook 96 and handle 97, allowing hook 96 to move to the left in FIG. 22*a* when handle 97 moves upward (hook 96 moves to the right when handle 97 moves downward). A compression spring 100 is affixed to handle 97 and functions to bias handle 97 upward and, therefore, hook 96 to the left and into engagement with catch 88 of forming die 30'. FIG. 23 is a partial cross-sectional side view of mandrel 10', forming die 30', and base 90 (illustrated in FIGS. 20, 21, and 22*a* and 22*b*, respectively) as assembled with hook 96 engaging catch 88 of forming die 30'.

Figure 24:
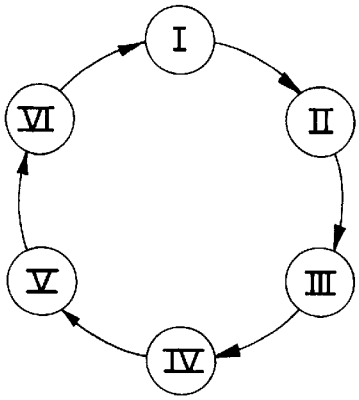
FIG. 24 is a schematic illustration of the various stations used in one embodiment of the method for packaging instant beverages in a beverage container according to the present invention.

FIG. 24 is a schematic illustration of the various stations used in one embodiment of the method for packaging instant beverages in a beverage container according to the present invention. The apparatus incorporates mandrel 10', forming die 30', and base 90 as well as several of the other components of the present invention discussed above and below.

At Station I (parallel FIG. 12), the apparatus of the present invention is in the compressed condition as shown and described above with respect to FIG. 23. Thus, hook 96 of latch 95 engages catch 88 of forming die 30' and holds forming die 30' down against the upward force of spring 19. Spring 19 is compressed between shelf 43 of forming die 30' and base 90 and is disposed around mandrel 10'. Filter disk 65 is placed over chamfer 32 of forming die 30'. Filter disk 65 is centered over forming die 30' to provide forming portion 67 and overhang portion 66 which are concentrically located around longitudinal axis "b" of forming die 30'.

At Station II (parallel FIG. 13), cylindrical press portion 52 of funnel press 50 is inserted into cavity 11 of mandrel 10' and against flange 20. A downward force is then applied to funnel press 50 toward base 90 thereby drawing forming portion 67 of filter disk 65 into cavity 11 of mandrel 10' until flange 20 and shoulder 54 simultaneously crimp filter disk 65 and form a pocket 81.

At Station III (also parallel FIG. 13), a measured amount of instant beverage material 80 is loaded into pocket 81, using through hole 56, by pouring instant beverage material 80 into funnel portion 51 of funnel press 50. Once an amount of instant beverage material 80 sufficient to fill pocket 81 is provided, funnel press 50 is removed and the apparatus rotates to Station IV.

At Station IV (parallel FIG. 14), insert disk 60 is placed into recess 45. As seen in FIG. 14, filter disk 65 has a pleated portion 68 which is produced during the formation of pocket 81 as described above. Insert disk 60 may be formed from a large sheet 110 of disk material, such as a thin sheet of metal. A cutting device 120 can punch a number of insert disks 60 from the same sheet 110.

Figure 25B:
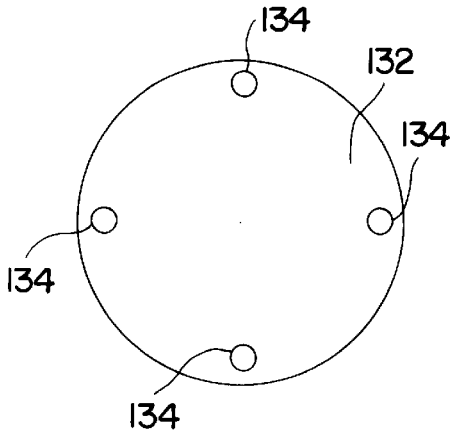
FIG. 25*b* is a top view of the cutting device shown in FIG. 25*a;*.
Figure 25A:
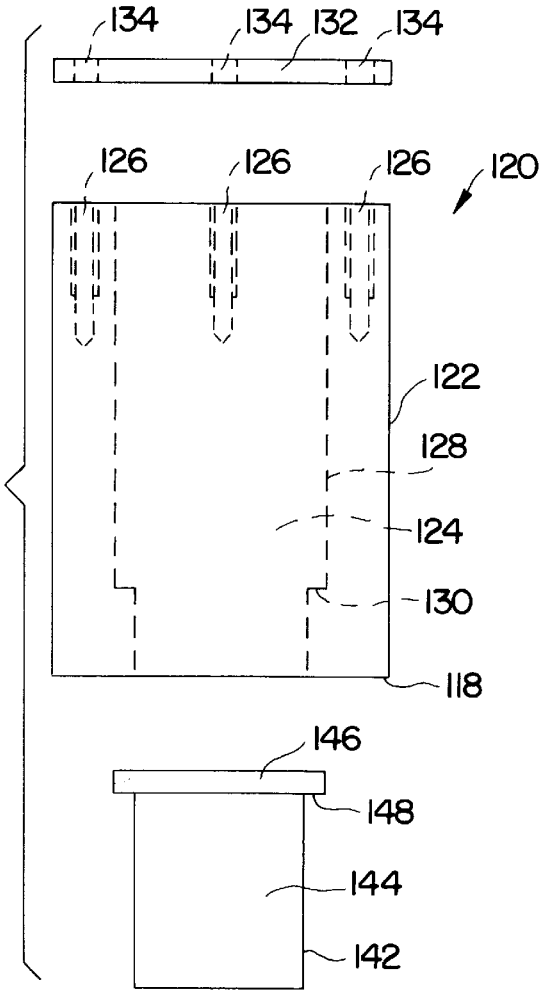
FIG. 25*a* is a partial cross-sectional side view of the cutting device of the present invention, illustrated in an unassembled position.

Cutting device 120 is shown in an unassembled position in FIG. 25*a*. Cutting device 120 has four main components: a housing 122, a cap 132, a plunger 142, and a compression spring 152. Housing 122 has a cutting edge 118, a central opening 124, and a series of orifices 126. The diameter of housing 122 is approximately the same as the diameter of insert disk 60 (2 inches is typical). The wall 128, which forms the inner surface of central opening 124, has a seat 130. The cap 132 of cutting device 120 has a series of passages 134 which correspond to orifices 126 in housing 122. Passages 134 and orifices 126 mate and receive conventional fasteners, such as bolts, to attach cap 132 to housing 122. The top view of cutting device 120 shown in FIG. 25*b* further illustrates cap 132.

Figure 26:
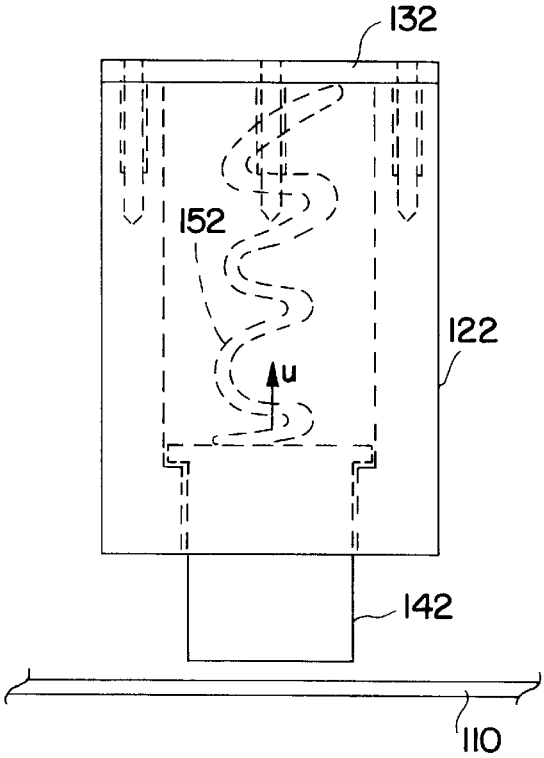
FIG. 26 is a partial cross-sectional side view of the cutting device of FIG. 25*a* as assembled and ready to engage a sheet of insert disk material.

Plunger 142 has a cylindrical body 144 and a head 146. Head 146 extends beyond body 144 to create a platform 148. As shown in FIG. 26, plunger 142 is slideably disposed in central opening 124 of housing 122. The spring 152 is also disposed in central opening 124 of housing 122. Spring 152 engages head 146 of plunger 142 on one end and cap 132 on its opposite end. In its extended (uncompressed) position, as shown in FIG. 26, spring 152 pushes downward on head 146 of plunger 142 so that platform 148 of head 146 engages seat 130 of housing 122. Body 144 of plunger 142 extends beyond housing 122, in the uncompressed position of FIG. 26, a sufficient distance (0.625 inches is suitable) to allow formation of pleated portion 68 of filter disk 65. Similarly, the diameter of plunger 142 (typically about one inch) is sufficiently less than the diameter of housing 122 to leave room for the formation of pleated portion 68 of filter disk 65.

FIG. 26 is a partial cross-sectional side view of cutting device 120 of FIG. 25*a* as assembled and ready to engage sheet 110 of material used to form insert disk 60. At Station IV, sheet 110 is positioned between cutting device 120 and the top of the assembly of mandrel 10' and forming die 30'. A punch mechanism (not shown) exerts a downward force on cutting device 120, forcing plunger 142 of cutting device 120 into contact with sheet 110. The continued application of downward force by the punch mechanism pushes plunger 142 upward into central opening 124 of housing 122, and compresses spring 152 in the direction of arrow "U" in FIG. 26, until plunger 142 is flush with cutting edge 118 of housing 122. At this point, the continued application of downward force by the punch mechanism pushes cutting edge 118 of housing 122 through sheet 110, thereby forming insert disk 60.

Once insert disk 60 is punched out of sheet 110, the downward force on the punch mechanism is stopped. Thus, the compressed force of spring 152 is released. This compressed force extends plunger 142 beyond housing 122 and pushes insert disk 60 into position in recess 45. Plunger 142 holds insert disk 60 in position for the next operation.

The next operation, also at Station IV, places the apparatus in the non-compressed condition (parallel FIG. 15) by removing hook 96 of latch 95 from catch 88 of forming die 30'. This action can be accomplished by exerting a downward force on handle 97 of latch 95, causing handle 97 to rotate clockwise about pivot point 98 thereby carrying hook 96 away from forming die 30'. The downward force can be exerted on handle 97 by any suitable mechanism; a roller (not shown) is one example. Upon release of catch 88, the elastic force provided by spring 19 pushes forming die 30' upward toward flange 20 so that engaging surface 22 of mandrel 10' meets flange support surface 39 of forming die 30'. During the upward motion of forming die 30' toward flange 20, cylindrical portion 40 collects pleated portion 68 so that pleated portion 68 is substantially perpendicular to and is contained within cylindrical portion 40. Finally, cutting device 120 is removed.

At Station V (parallel FIG. 16), a beverage container 70 is inverted and placed over the apparatus in the non-compressed condition. An axial, downward force is then applied to horizontal bottom wall 72 of inverted beverage container 70 toward base 90 which causes the following sequence of steps to occur. First, chamfer 32 of forming die 30' engages and is stopped by the inner surface 74 of side wall 73 of beverage container 70. Simultaneously, lip 75 of beverage container 70 engages and is stopped by ledge 35 of forming die 30'. These engagements and stops prevent further relative movement between forming die 30' and beverage container 70.

Upon further application of downward force in direction F, flange 20 of mandrel 10' continues to advance filter disk 65, insert disk 60, and instant beverage material 80 toward horizontal bottom wall 72 of beverage container 70 as forming die 30' and beverage container 70 move downward relative to mandrel 10'. This continued downward motion of forming die 30' and beverage container 70 causes pleated portion 68, upon contacting the bottom surface 71 of horizontal bottom wall 72, to fold back over insert disk 60 and wedge between insert disk 60 and bottom surface 71 (parallel FIG. 17). Insert disk 60 provides a friction fit which wedges insert disk 60 inside the bottom of beverage container 70. Insert disk 60 may even "bite" into inner surface 74 of beverage container 70, penetrating inner surface 74 of beverage container 70 slightly, to create a seal. The continued downward motion also causes hook 96 of latch 95 to again engage catch 88 of forming die 30', thus holding forming die 30' in a compressed condition (see FIG. 23).

At Station VI, a finished beverage container 70, thus produced, is removed from the apparatus and is shown in FIG. 18. Finally, the apparatus is rotated back to Station I. This completes one round of Stations I through VI. A series of six separate apparatus can be positioned on base 90 to manufacture beverage containers 70 on a continuous basis. Of course, the number of stations can be varied, with the particular operation steps to be performed on the apparatus at each station changed, as would be clear to a skilled artisan.

Thus, according to the present invention an apparatus and method are provided for making a beverage container which contains an instant beverage material individually sealed within the beverage container using a filter disk and an insert disk. As a result of these improvements in the present invention, because the cups are individually sealed with a filter, the beverage product remains constrained within the cup without the need for stacking as in the prior art. Thus, these improvements further eliminate the need for any further measures to ensure that the cups remain stacked to maintain the seal.

Although illustrated and described with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A system for packaging all instant beverage material in a package, including a filter disk having a first portion and an insert disk, and disposing said instant beverage material and package in a beverage container having a bottom with a bottom diameter, the apparatus comprising:

a mandrel having a flange;

a forming die slideably mounted on the mandrel and having an inner stepped portion configured to engage the flange of the mandrel and adapted to receive the filter disk and insert disk; and a funnel press having a funnel portion and a press portion, the press portion mating with the mandrel and forming die and adapted to draw the first portion of the filter disk into the mandrel to form a pocket in and crimp the filter disk, which may be subsequently loaded with the instant beverage material using the funnel portion;

the insert disk adapted to be placed over the instant beverage material to secure the instant beverage material within the pocket formed in the filter disk, and the mandrel and the mounted forming die adapted to interact and thereby fold a portion of the filter disk over the insert disk and insert the filter disk, insert disk, and instant beverage material securely into the bottom of the beverage container.

2. The system according to claim 1 further comprising means for biasing the forming die in a first position relative to the mandrel and releasing the forming die to a second position relative to the mandrel, the biasing means attached to the mandrel.

3. The system according to claim 2 wherein the biasing means includes a spring.

4. The system according to claim 3 wherein the forming die has a catch and the biasing means further includes a base having a latch adapted to engage the catch of the forming die.

5. The system according to claim 1 wherein the forming die has an inner surface diameter, the mandrel has an outer surface diameter, and the inner surface diameter of the forming die is slightly larger than the outer surface diameter of the mandrel.

6. The system according to claim 1 wherein the forming die has an outer surfaces and a portion of said outer surface being angled inwardly to provide a chamfer.

7. The system according to claim 6 wherein the angle of said chamfer is adapted to fit into the beverage container.

8. The system according to claim 1 wherein the forming die has an outer surface diameter, and the outer surface diameter of the forming die is adapted to be smaller than an outer diameter of the filter disk.

9. A system for packaging an instant beverage material in a beverage container having a bottom with a bottom diameter, the combination comprising:

a filter disk having a first portion and an outer diameter;

an insert disk having a diameter which is slightly greater than the bottom diameter of the beverage container, whereby the insert disk provides a friction fit wedging the insert disk inside the beverage container adjacent the bottom of the beverage container;

a mandrel having a flange and an outer surface diameter;

a forming die slideably mounted on the mandrel and having (a) a chamfered outer surface adapted to fit into the beverage container, (b) an inner stepped portion configured to engage the flange of the mandrel and to receive the filter disk and insert disk, (c) an inner surface diameter slightly larger than the outer surface diameter of the mandrel, and (d) an outer surface diameter smaller than the outer diameter of the filter disk;

means for biasing the forming die in a first position relative to the mandrel and releasing the forming die to a second position relative to the mandrel, the biasing means attached to the mandrel; and a funnel press having a funnel portion and a press portion, the press portion mating with the mandrel and forming die to draw the first portion of the filter disk into the mandrel to simultaneously form a pocket in and crimp the filter disk which is subsequently loaded with the instant beverage material using the funnel portion;

the insert disk adapted to be placed over the instant beverage material to secure the instant beverage material within the pocket formed in the filter disk, and the mandrel and forming die interact to fold a portion of the filter disk over the insert disk and insert the filter disk, insert disk, and instant beverage material securely into the bottom of the beverage container.

10. The system according to claim 9 wherein the biasing means includes a spring.

11. The system according to claim 10 wherein the forming die has a catch and the biasing means further includes a base having a latch adapted to engage the catch of the forming die.

12. The system according to claim 11 wherein the latch has a hook and a handle elastically attached to the base.

13. The system according to claim 9 wherein the filter disk is permeable by water.

14. The system according to claim 9 further comprising a cutting device for punching the insert disk from a sheet of insert disk material, the cutting device has a housing with a first end, a cutting edge opposite the first end, a diameter, and a central opening; a cap closing the first end of the housing; a plunger slideably disposed in the central opening of the housing; and a compression spring disposed in the central opening of the housing and engaging the plunger on one end and the cap on its opposite end.

15. The system according to claim 14 wherein the diameter of the housing is approximately the same as the diameter of the insert disk.

16. The system according to claim 14 wherein the cutting device plunger extends beyond the cutting device housing when the spring is in an uncompressed position.

17. The system according to claim 14 wherein the plunger has a diameter which is less than the diameter of the housing.

* * * * *